US005743218A

United States Patent [19]

Aupperle et al.

[11] Patent Number: 5,743,218

[45] Date of Patent: Apr. 28, 1998

[54] LIQUID COOLED CYLINDER HEAD FOR AN INTERNAL COMBUSTION ENGINE

[75] Inventors: Walter Aupperle, Korb; Heinrich Jurka, Murrhardt, both of Germany

[73] Assignee: Mercedes-Benz AG, Stuttgart, Germany

[21] Appl. No.: 778,755

[22] Filed: Jan. 6, 1997

[30] Foreign Application Priority Data

Jan. 9, 1996 [DE] Germany ..... 196 00 448.9

[51] Int. Cl.[6] ..... F02F 1/38

[52] U.S. Cl. ..... 123/41.82 R; 123/193.5

[58] Field of Search ..... 123/41.82 R, 193.5

[56] References Cited

U.S. PATENT DOCUMENTS 4,889,079 12/1989 Takeda et al. ..... 123/41.82 R

FOREIGN PATENT DOCUMENTS 35 13 126 2/1987 Germany .

*Primary Examiner*—Noah P. Kamen

*Attorney, Agent, or Firm*—Klaus J. Bach

[57] ABSTRACT

A liquid cooled cylinder head for a multi-cylinder internal combustion engine is formed as a single piece casting with a water space defined between outer side walls and spaced cylinder head bottom and top walls. Gas flow channels extend through the water space from valve openings in the cylinderhead bottom to openings in the outer side walls. Support columns with bores extend between the cylinder head bottom and top walls for receiving cylinder head mounting bolts. The cylinder head bottom wall is provided within the water space, with reinforcement ribs which extend between, and are connected to, the gas flow channels and the support columns so as to provide a rigid compound structure.

2 Claims, 1 Drawing Sheet

LIQUID COOLED CYLINDER HEAD FOR AN INTERNAL COMBUSTION ENGINE

BACKGROUND OF THE INVENTION

The invention relates to a liquid-cooled cylinder head for a multi-cylinder internal combustion engine including a cooling water space defined between outer side walls, a cylinder head bottom and a cylinder head top wall.

DE 35 13 126 C2 discloses such a cylinder head. It includes a cylinder head top wall, which is provided with a web extending longitudinally along the center of the cylinder head top wall, and is connected to the cylinder head top wall by way of vertical connecting ribs to provide for a rigid cylinder head structure.

It is the object of the present invention to provide a cylinder head, wherein, by improved utilization of components already present in a cylinder head, the rigidity of the cylinder head is increased.

SUMMARY OF THE INVENTION

A liquid cooled cylinder head for a multi-cylinder internal combustion engine is formed as a single piece casting with a water space defined between outer side walls and spaced cylinder head bottom and top walls. Gas flow channels extend through the water space from valve openings in the cylinderhead bottom to openings in the outer side walls. Support columns with bores extend between the cylinder head bottom and top walls for receiving cylinder head mounting bolts. The cylinder head bottom wall is provided within the water space, with reinforcement ribs that extend between, and are connected to, the gas flow channels and the support columns so as to provide a rigid compound structure.

In this cylinder head, the gas intake and exhaust channels, as well as the support columns for receiving the cylinder head mounting bolts, are interconnected as building components which, together, increase the rigidity of the cylinder head. By interconnecting these components with reinforcement ribs, at least the cylinder head bottom areas disposed between those building components are strengthened. This novel reinforcement structure including gas channels, reinforcement ribs and support columns, utilizes, in an advantageous manner, components which are present in the cylinder head anyhow. These components, however, are so arranged that the rigidity and strength of the cylinder head bottom is increased.

The invention will become more readily apparent from the following description of an embodiment thereof given below on the basis of the accompanying drawings.

DESCRIPTION OF A PREFERRED EMBODIMENT

Figure 1:
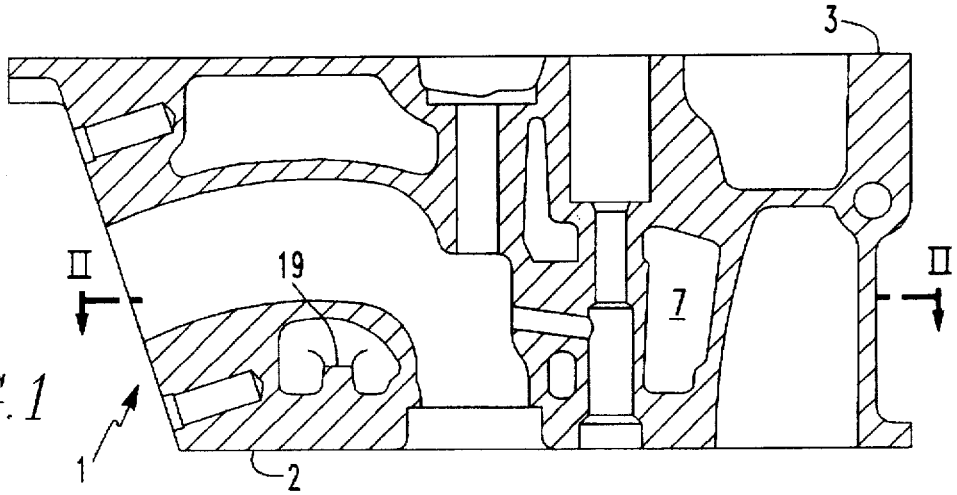
FIG. 1 is a cross-sectional view of the cylinder head according to the invention taken along line I—I of FIG. 2
Figure 2:
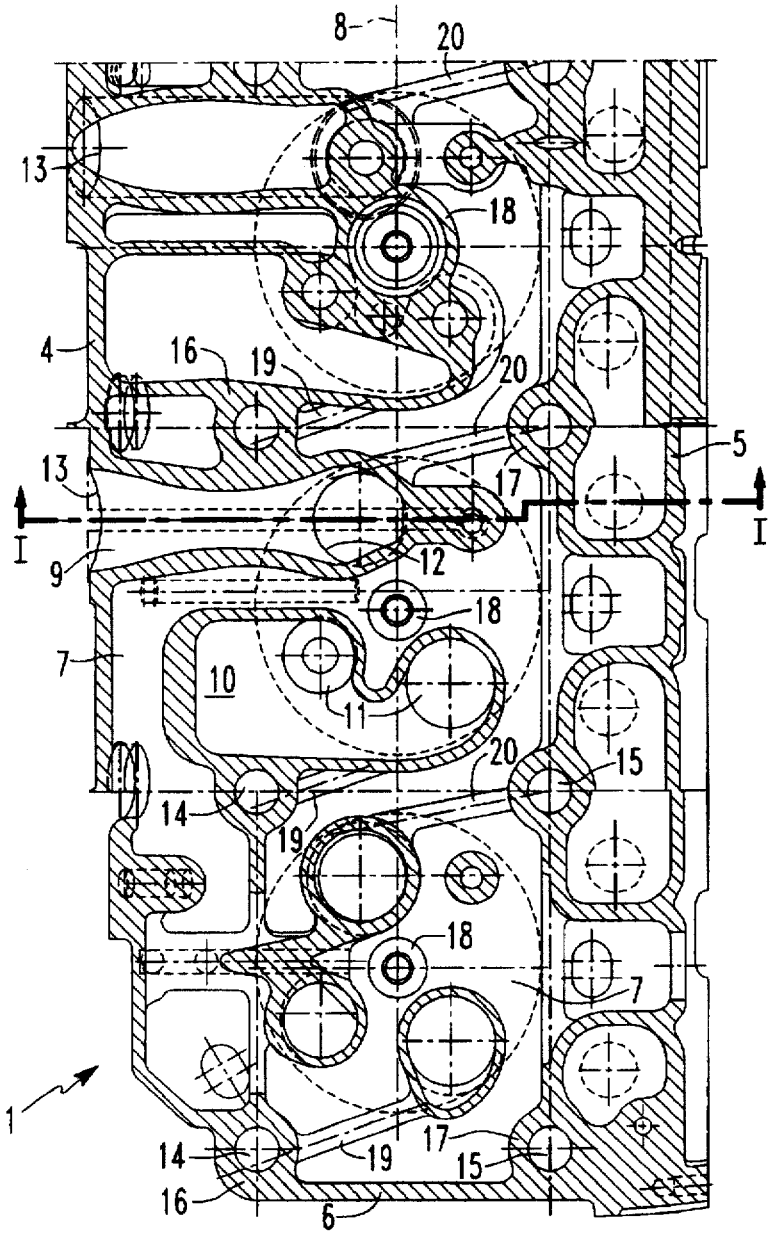
FIG. 2 is a cross-sectional view of the cylinder head taken in a horizontal plane along line II—II of FIG. 1.

A cylinder head 1 for a multi-cylinder, four-cycle internal combustion engine consists of a single piece casting. The casting comprises a cylinder head bottom wall 2 with longitudinal outer side walls 4, 5 extending upwardly from the cylinder head bottom wall 2 to the cylinder head top wall 3 and front and rear outer walls 6. The top ends of the outside walls 4, 5 and 6 are machined plane so that a cylinder head cover can be mounted thereon.

The cylinder head bottom wall 2 and the cylinder head top wall 3 which is disposed at a distance from the cylinder head bottom wall 2 delimit, together with the outside walls 4, 5 and 6, a cooling water space 7.

The cooling water space 7 is penetrated by gas flow channels 9, 10 extending transversely to the longitudinal axis 8 of the cylinder head. The gas flow channel 9 is an exhaust gas channel and the gas flow channel 10 is an intake gas channel. The gas flow channels 9 and 10 extend from the valve openings 11 and 12 in the cylinder head bottom wall 2 to channel openings in the outside side wall 4 of the cylinder head. In the figures, only the channel openings 13 of the exhaust gas channels are shown.

The cylinder head 1 is mounted onto an engine block, which is not shown, by means of cylinder head mounting bolts extending through bores 14, 15 in support columns 16, 17. Four cylinder head mounting bolts are provided for each cylinder. In order to achieve an as uniform as possible engagement of the cylinder head 1 with the engine block, the cylinder head bolts and, consequently, also the support columns 16, 17 are arranged near the outside side walls 4 and 5. That is, the support columns 16 are arranged near the outside side wall 4 and the support columns 17 are arranged near the outside side wall 5. The support columns 16 and 17 are cast into the housing structure of the cylinder head 1 so that the engagement forces generated by the cylinder head mounting bolts are transmitted, by way of the support columns, as uniformly as possible to the cylinder head gasket disposed between the cylinder head 1 and the engine block.

It is also important that the gas forces effective on the cylinder head bottom wall 2 are transmitted to the components of the cylinder head as uniformly as possible in order to avoid stress peaks and compliance, particularly in the area of the cylinder head bottom wall 2. In order to increase the rigidity, the support columns 16 and 17 are not only connected between the cylinder head bottom wall 2 and the cylinder head top wall 3 but they are also connected to the walls of the gas flow channels 9 and 10. The rigidity is further increased by the walls of the reception chambers 18 for the injectors or the spark plugs which are arranged in the cylinder head centrally over each cylinder and are connected to the cylinder bottom as well as to the cylinder top wall.

In order to further increase the rigidity of the cylinder head 1, the cylinder head bottom 2 is, in accordance with the invention, reinforced by reinforcement ribs 19 and 20 which are arranged in the water space of the cylinder head. The reinforcement ribs 19 and 20 which project from the cylinder head bottom wall 2 into the cooling water space 7 extend, with some inclination, essentially in the longitudinal direction of the cylinder head. They interconnect, and are integrally cast with, the support columns 16 and the gas intake channels 10. The reinforcement ribs 20 interconnect, and are integrally cast with, the support columns 17 and the exhaust gas channels 9.

The compound arrangement of the gas flow channels 9 and 10, the support columns 16 and 17 and the reinforcement ribs 19 and 20 provides, in a simple manner, for substantially increased rigidity and resistance of the cylinder head 1. In particular, the cylinder head bottom wall 2 is protected from the bending stresses generated by the gas forces in the cylinders. These forces are uniformly distributed to the cylinder head 1 by the compound structural arrangement in which the reinforcement ribs 19 and 20 are joined with the support columns 16 and 17 and with the gas channels 9 and 10.

The reinforcement ribs 19 and the walls of the gas intake channels 10 and, respectively, the support columns 16, and the reinforcement ribs 20 are joined with the walls of the gas exhaust channels 9 and, respectively, the support columns 17. As a result, a relatively large area of the cylinder head bottom is strengthened.

What is claimed is:

1. A liquid cooled cylinder head for a multi-cylinder internal combustion engine including a cooling water space defined between outer side walls, a cylinder head bottom wall and a cylinder head top wall disposed above the cylinder head bottom wall in spaced relationship therefrom, with gas intake and exhaust channels extending transversely through said water space from valve openings formed in said cylinder head bottom wall to channel openings in a cylinder head side wall, reception chambers extending centrally above each cylinder through said cooling water space between said cylinder head bottom and said cylinder head top walls and between said gas intake and exhaust channels for receiving injectors or spark plugs, support columns extending in said water space between said cylinder head bottom and said cylinder head top walls and having bores for receiving cylinder head mounting bolts, and reinforcement ribs formed on the cylinder head bottom wall in said water space, said reinforcement ribs extending straight between, and joining, adjacent support columns and gas flow channels to form a rigid compound structure.

2. A cylinder head according to claim 1, wherein said reinforcement ribs are inclined with respect to a longitudinal and a transverse axis of said cylinder head.

* * * * *